US005418321A

United States Patent [19]

Keller et al.

[11] Patent Number: 5,418,321

[45] Date of Patent: May 23, 1995

[54] AUDIO CHANNEL SYSTEM FOR PROVIDING AN ANALOG SIGNAL CORRESPONDING TO A SOUND WAVEFORM IN A COMPUTER SYSTEM

[75] Inventors: Glenn J. Keller, Los Gatos, Calif.; Timothy J. McDonald, West Chester, Pa.; James Redfield, West Chester, Pa.; Robert S. Schmid, West Chester, Pa.

[73] Assignee: Commodore Electronics, Limited, Nassau, Bahamas

[21] Appl. No.: 991,059

[22] Filed: Dec. 15, 1992

[51] Int. Cl.[6] ..... G10H 7/00

[52] U.S. Cl. ..... 84/606; 84/633

[58] Field of Search ..... 84/604, 606, 655, 633, 84/653

[56] References Cited

U.S. PATENT DOCUMENTS 4,338,674 7/1982 Hamada ..... 84/604

5,038,661 8/1991 Kaneko ..... 84/604

FOREIGN PATENT DOCUMENTS 0035658 9/1981 European Pat. Off. ..... 84/606

OTHER PUBLICATIONS

Horowitz and Hill, Art of Electronics, pp. 416–419 (Analog–Digital Conversion), 1980.

Amiga Hardware Reference Manual, Chapters 5, 8, pp. 131–164, (Audio Hardware), pp. 215–227 (Interface Hardware), 1986.

Mano, Computers System Architecture, 2nd Ed., pp. 366–367, (hardware implementation of signed 2's complement numbers), pp. 372–375, (Booth's Multiplication Algorithm), 1982.

*Primary Examiner*—Curtis Kuntz

*Assistant Examiner*—Ping W. Lee

*Attorney, Agent, or Firm*—Panitch Schwarze Jacobs & Nadel

[57] ABSTRACT

An audio channel system provides an analog signal corresponding to a sound waveform in a computer system. The audio channel system includes a plurality of audio channels. Each audio channel contains a predetermined number of audio data samples for producing a particular sound waveform. A plurality of volume bits define a volume level of each audio data sample to be played. An audio processor processes the sound waveforms of each audio channel. The audio processor acts as a shared processing element which receives the audio data samples from each audio channel. The audio processor divides the audio data samples into a plurality of data such that the plurality of data for each audio data sample is pipelined through the audio processor in a serial manner. The plurality of data for each audio data sample for each audio channel is in various processing stages at any given time. The audio processor combines the data samples and volume bits to produce an audio output signal for each audio channel to produce a total audio output signal.

10 Claims, 10 Drawing Sheets

34
8
NEWCTL
32
18
NEWDATA
LEN CNT
PER CNT
BUFFER
ACCUM
CNTRL RAM
VARIABLE RAM
LEN CNT
PER CNT
BUFFER
ACCUM
AW
AR
WP
18
100
8
CTL
LENCNT2
LENCNT1
18
DLEFT
102
8
DMID
8H
8L
M1
M2
106
PERFIN/N
PERFIN
PERFIN
DLEFT
2:0
8:6
3
180
192
SAVEPER
16
A

| $M_1, M_0, M_{-1}$ | MODIFIED BOOTH'S OPERATIONS |
|---|---|
| 000 | >>2 |
| 001 | +, >>2 |
| 010 | +, >>2 |
| 011 | >>1, +, >>1 |
| 100 | >>1, -, >>1 |
| 101 | -, >>2 |
| 110 | -, >>2 |
| 111 | >>2 |

AUDIO CHANNEL SYSTEM FOR PROVIDING AN ANALOG SIGNAL CORRESPONDING TO A SOUND WAVEFORM IN A COMPUTER SYSTEM

BACKGROUND OF THE INVENTION

The present invention relates to an audio channel system and, more particularly, to an audio channel system for outputting an analog signal corresponding to a sound waveform in a personal computer system by using shared processing elements.

Many prior art personal computers typically have high quality graphics, but do not always have high quality audio systems. The prior art audio systems tend to be somewhat simple in structure and produce tinny synthesized audio outputs.

Since computers cannot store analog waveform information, computer production of a sound must be represented as a finite string of digital signals. The time axis of a single sound waveform is divided into equal segments, each of which represents a small segment of time so that the waveform remains essentially stable. Each resulting segment is called an audio data sample. The samples are stored in the memory of the computer and can be played at any desired frequency. The computer feeds each sample to a digital to analog converter which changes the data sample into an analog voltage waveform which is then transmitted to an amplifier and a loud speaker. Frequently, the audio system comprises a small number of audio channels which are evenly divided between a left audio channel and a right audio channel. Each audio channel is usually programmed independently of the other audio channels and processed by separate audio processors. Since the audio processors may not always be perfectly synchronized with one another, this can cause malfunction (so called "glitches") in the audio output which result in poor sound quality. A "glitch" occurs when an undesired transient voltage spike occurs as a signal is being processed.

It would be advantageous for a computer to have an audio system which produces compact disc (CD) quality sound and in which each audio channel is processed synchronously using a shared processing element to produce high performance sound quality. In order for an audio system to produce CD quality sound, it must operate at a minimum sampling frequency of 44 KHz, which requires that the sound waveform to be played be processed quickly in order to achieve the desired sampling frequency.

The present invention is directed to an audio channel system for outputting an analog signal corresponding to a sound waveform in a personal computer system. The audio system includes eight audio channels, each of which is capable of producing a sound waveform comprising a predetermined number of audio data samples. Each audio channel is capable of being directed to a left audio channel, a right audio channel, both audio channels or neither audio channel. Each audio channel is pipelined serially into a single audio processing loop or shared processing element. A retiming RAM fine adjusts each data sample which is to be outputted. A pair of digital to analog converters direct the data samples to the appropriate channel. The data signals may also be outputted via a digital output shift register. The left and right digital audio values are also output via a digital shift register.

SUMMARY OF THE INVENTION

An audio channel system provides an analog signal corresponding to a sound waveform in a computer system. The computer system includes a processor, a system memory for storing data, and a data bus coupled to the audio channel system for receiving audio input. The audio channel system comprises a plurality of audio channels. Each audio channel contains a predetermined number of audio data samples for producing a particular sound waveform. A plurality of volume bits define a volume level of each audio data sample to be played. Audio processing means process the sound waveforms of each audio channel. The audio processing means acts as a shared processing element which receives the audio data samples from each audio channel. The audio processing means divides the audio data samples into a plurality of data such that the plurality of data for each audio data sample is pipelined through the audio processing means in a serial manner. The plurality of data for each audio data sample for each audio channel is in various processing stages at any given time. The audio processing means combines the data samples and the volume bits to produce an audio output signal for each audio channel. Output means combine the audio output signal of each audio channel to produce a total audio output signal.

The present invention is also directed to a method for outputting an analog signal corresponding to a digital sound waveform. The method comprises the steps of receiving audio data samples for a plurality of audio channels from a data input circuit. Each audio data sample is separated into length data, period data, buffer data and accumulator data. The audio data samples are transmitted to the audio processing loop. The length data, period data, buffer data and accumulator data are pipelined in a staggered manner for a first audio channel through the audio processing loop. The buffer data and accumulator data of the first audio channel are multiplied in accordance with Modified Booth's algorithm. The product of the buffer data and accumulator is stored in memory. The length data, period data, buffer data and accumulator data are pipelined in a staggered manner for a succeeding audio channel through the audio processing loop once the audio data sample for a preceding audio channel has been entered. The buffer data and accumulator data of the succeeding audio channel is multiplied in accordance with Modified Booth's algorithm. The product of the buffer data and accumulator data for the succeeding audio channel are stored in memory. Each succeeding audio channel is processed as described above until all of the audio channels have entered the audio processing loop. The above steps are further repeated until each audio data sample for each audio channel has been completely processed. The processed audio data samples for each audio channel are combined to produce an audio output having a sampling frequency of up to 110 KHz.

BRIEF DESCRIPTION OF THE DRAWINGS

The foregoing summary, as well as the following detailed description of the preferred embodiment, will be better understood when read in conjunction with the appended drawings. For the purpose of illustrating the invention, there is shown in the drawings an embodiment which is presently preferred, it being understood, however, that the invention is not limited to the specific methods and instrumentalities disclosed.

In the drawings.

DESCRIPTION OF PREFERRED EMBODIMENT

Figure 1:
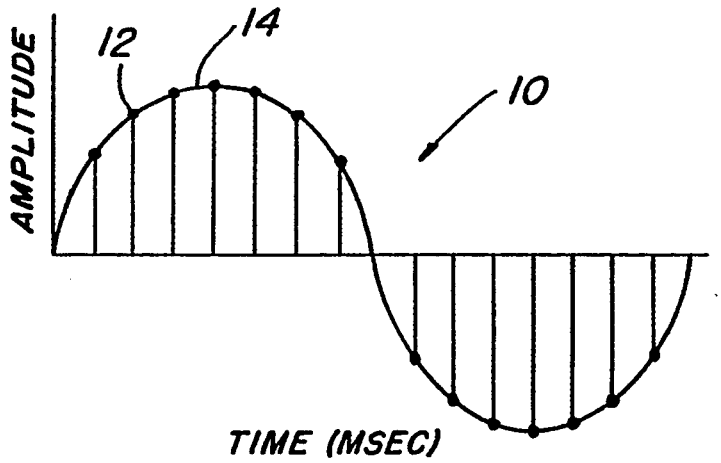
FIG. 1 is a graph of an audio data sample in accordance with the present invention.

Referring to the drawings wherein like numerals indicate like elements throughout, there is shown in FIG. 1 a graph depicting a simple sound waveform 10 in accordance with the present invention. The sound waveform illustrated as a sine wave representing a simple tone. The general shape of the sound waveform determines its tone quality. It is to be understood by those skilled in the art that the sound waveform depicted in FIG. 1 is purely exemplary and that any type of sound waveform can be implemented without departing from the scope and spirit of the present invention.

Each sound waveform 10 is made up of a plurality of audio data samples 12. Each audio data sample 12 represents a single piece of audio data. The audio data samples 12 are divided into equal time segments which represent a small period of time in which the audio waveform remains substantially constant. It is to be understood by those skilled in the art that there are more audio data samples in the waveform of FIG. 1 than depicted on the drawing. The horizontal axis of the graph represents the time period and the vertical axis of the graph represents the amplitude of the waveform. The distance between each data sample 12 and the horizontal axis of the graph depicts the specific amplitude of each data sample 12. The amplitude of each data sample 12 is related to the volume of the sound produced. The amount of time necessary to play each data sample 12 is identified as the period 14 which is indicated by the line following each data sample point and extends to the next data point in the waveform. The number of data samples 12 contained in each sound waveform 10 indicates the length of the sound waveform 10.

Figure 2:
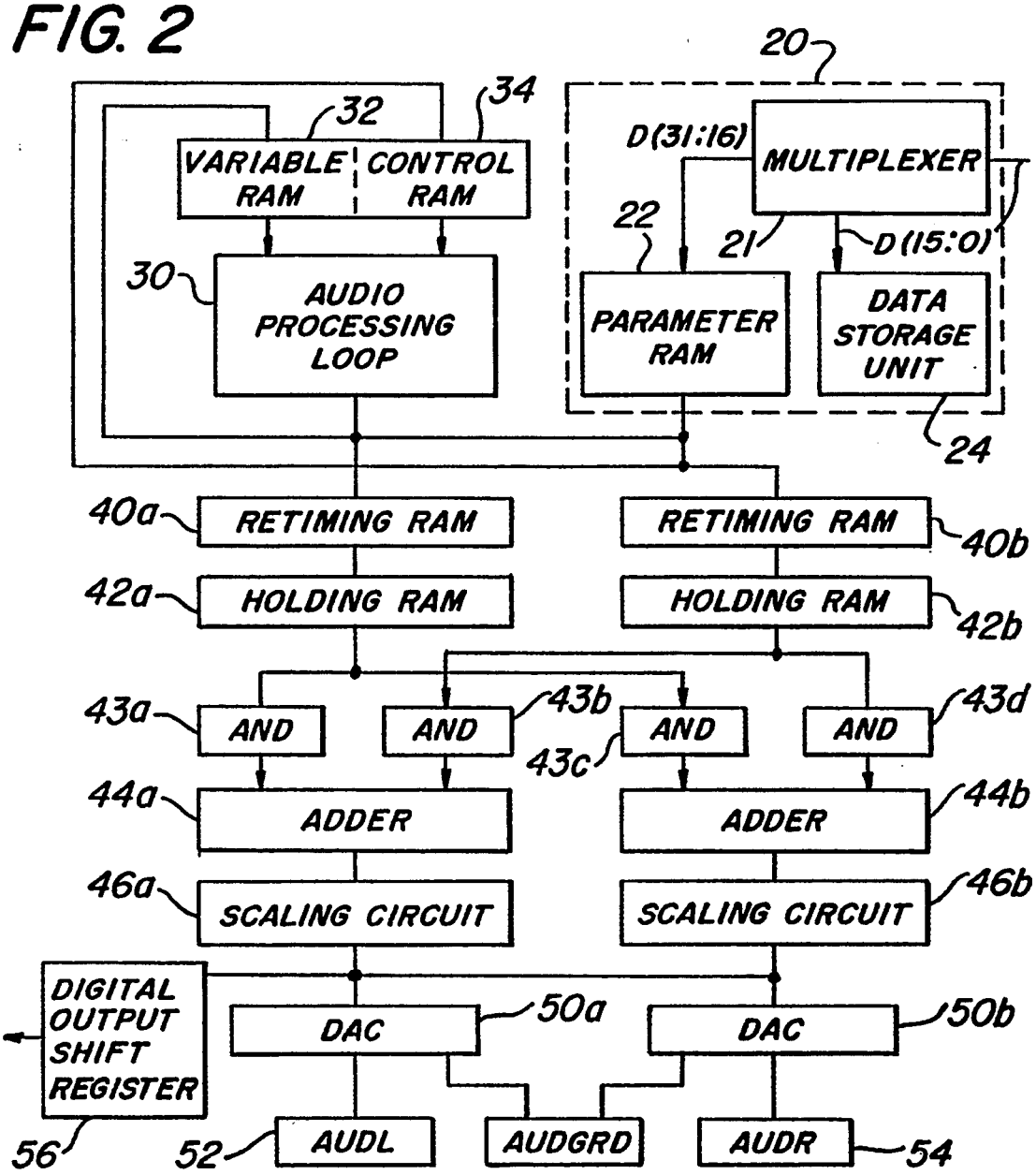
FIG. 2 is a schematic block diagram of the audio channel system in accordance with the present invention.

Referring to FIG. 2, there is shown a general block diagram depicting a preferred embodiment of an audio channel system for producing an analog signal for a particular sound waveform in accordance with the present invention. In the preferred embodiment, the audio channel system is located within a computer system such as a personal computer. However it is to be understood that any type of computer system or audio system can be implemented without departing from the scope and spirit of the present invention. Data defining a particular sound waveform 10 are received at a data input circuit 20. The data can be received from a plurality of sources located within the personal computer including, but not limited to, a DMA channel or a dedicated processor. It is to be understood by those skilled in the art that any suitable means for achieving data can be used in the system without departing from the scope and spirit of the present invention.

In the preferred embodiment, the audio data are either received in 16 bit or 32 bit blocks. A 16 bit block can contain a 16 bit data word or a pair of 8 bit data words contained within the upper and lower 8 bits of the 16 bit block. A 32 bit block of data received by the data input circuit 20 typically comprises two 16 bit data words or four 8 bit words. A data block transmitted to the data input circuit 20 is received by a 32 bit multiplexer 21. The data received by the multiplexer 21 are separated into each individual audio channel prior to further processing. In the preferred embodiment, each audio channel contains 4 pieces of data which include length data, period data, volume data and audio data. The length data determine the number of audio data samples contained within the sound waveform. The period data define the period of time in which the sound waveform is played. The volume data determine the perceived loudness of each audio data sample. The audio data contain the particular data samples which are to be played. However, it is to be understood by those skilled in the art that any type of data may be used to process the input data without departing from the scope and spirit of the present invention.

In the preferred embodiment, the audio processing system is only capable of processing 16 bits of audio data at a time. However, any arbitrary number of bits of audio data may be processed at one time without departing from the scope and spirit of the present invention. Once the number of words contained within a particular data block is determined, the data are transmitted to the audio processing loop in blocks of 16 bits. When a 16 bit data block is received by the data input circuit 20, the data are transmitted directly to a parameter RAM 22 which formats the data for processing in an audio processing loop 30 or shared processing element which will be described in detail hereinafter.

When a 32 bit data block is received by the data input circuit 20, the upper 16 bits of the data block are initially transmitted to the parameter RAM 22 for formatting and processing the data. The lower 16 data bits of the 32 bit data block are transferred to a data storage unit 24 which stores the data bits until the upper 16 bits have been transmitted to the audio processing loop 30. Once the upper 16 bits have been processed (period timeout), the lower 16 bits are transmitted to the parameter RAM 22 on a per channel basis. By accessing the data in 32 bit blocks, fewer data write commands are required to retrieve the data and twice as much data can be accessed by the data input circuit 20 at one time.

The parameter RAM 22 is preferably 32 bits deep and 16 bits wide and is capable of storing data for 8 audio channels. The 16 data bits for a single audio channel are received by the parameter RAM 22 and classified into the different types of data which may be written into the audio channel system. The types of data which may be received by the data input circuit 20 include, but are not limited to, the length, period, volume and audio data as described above. The type of data received by the parameter RAM 22 is determined by an address channel. Each address channel has its own address register which is preferably 11 bits in length which defines the address of the specific audio channel. However, the address register may be of any suitable length without departing from the scope and spirit of the present invention.

Each data block received by the data input circuit 20 is written to a particular audio channel which is to be processed in the audio processing loop 30. In the preferred embodiment, the audio processing loop 30 comprises 8 audio channels (not shown). However, it is to be understood by those skilled in the art that any particular number of audio channels can be used without departing from the scope and spirit of the present invention. The data blocks received by each audio channel encompass the data necessary for producing a sound waveform. These data include, but are not limited to, the number of audio data samples in the sound waveform, and the period between data samples and the amplitude of each data sample. The data contained within each channel are broken down into audio sample data bits and volume bits. In the preferred embodiment, the volume comprises 12 bits of data. However, it is to be understood that the volume can comprise any number of bits without departing from the scope and spirit of the present invention.

An audio processing loop 30 receives each of the eight audio channels in serial manner from the parameter RAM 22. The audio processing loop 30 is preferably a shared processing element which is capable of processing all 8 audio channels at substantially the same time. Each channel is pipelined through the audio loop for providing maximum processing efficiency as will be described in detail hereinafter. Pipelining is a procedure for processing the audio channels more rapidly by dividing the audio data samples into numerous small stages as will be described in detail hereinafter so that the processing of each audio channel is in various stages at a given time. For example, if the audio circuit comprises 8 audio channels, the data from each audio channel are processed in serial fashion such that all 8 channels are processed one after the other. The data contained within each audio channel are divided between a variable RAM 32 and a control RAM 34. Data defining the sound waveform contained within a channel are transmitted to the variable RAM 32. The variable RAM 32 is preferably 18 bits wide and 32 bits deep and stores the audio data for all 8 audio channels at one time. The variable RAM 32 contains the length data and period data as defined above and further contains buffer data and accumulator data. The buffer data contains the audio data samples for each audio channel. The accumulator data contains the results of the audio data samples multiplied by the volume bits as will be described in detail hereinafter and stores each immediate result as it is performed by the audio loop. The variable RAM 32 continually pipelines pieces of data through the audio processing loop 30 and stores the data results once the data has completed the loop 30.

The volume bits and other control bits are transmitted to the control RAM 34. In the preferred embodiment, the control RAM 34 is 8 bits wide and 32 bits deep. In addition, the control RAM 34 is responsible for storing the multiply states used to combine the audio data and volume data in accordance with the Modified Booth's algorithm as will be described in detail hereinafter. The audio processing loop 30 operates on the basis of a 280 ns clock in which each clock pulse is equal to 280 ns and includes 4 clock ticks which are each 70 ns in duration. In the preferred embodiment, it takes one clock pulse or 280 ns for each audio channel to be processed by the audio processing loop 30. Each time the data in the audio channel cycle through the loop 30, the audio data sample is multiplied by a predetermined number of volume bits using a complex algorithm. In the preferred embodiment, the so called "Modified Booth's" algorithm, well-known to those practicing in the art, is used to perform the multiplication function, the product of which is stored in the accumulator data. In the preferred embodiment, the processing of each data sample requires a minimum of 6 cycles through the audio loop 30.

Each time the data sample cycles through the audio loop 30, a portion of the period for the data sample expires. As discussed above, the period value is proportional to the time interval between the sound waveform samples. In the preferred embodiment, a piece of data from a single audio channel is processed through a single cycle of the audio processing loop 30. For example, if the period value for a particular data sample is 65 clock pulses, the time period between when the data first circulates through the loop and the second time the data circulates through the loop will be 8 clock pulses since each audio channel will cycle through the loop during the interim and take one clock pulse. Therefore, the remaining period value for the particular data sample during the second cycle through the loop 30 will be 57 clock pulses.

Once the data sample has been multiplied by all 12 volume bits, it is determined whether the period for the particular data sample has expired. If the period has not completely run out, the data sample continues to cycle through the audio loop 30 until the remaining period is 7 clock pulses or less. Once the period is 7 clock pulses or less, the data sample exits the audio processing loop 30 and enters one of two retiming RAMs **40*a*, 40*b*. In the preferred embodiment, two retiming RAMs 40*a*, 40*b*** are used to speed up the processing of the audio data samples. However, it is to be understood by those skilled in the art that any number of retiming RAMs may be used without departing from the scope and spirit of the present invention.

In the preferred embodiment, each retiming RAM **40*a*, 40*b* is 18 bits wide and 4 bits deep. A single audio channel is received by each retiming RAM 40*a*, 40*b* at any given time. Each retiming RAM 40*a*, 40*b* runs on a 70 ns clock pulse and processes a single audio data sample during each clock pulse. While a particular channel is being processed in each retiming RAM 40*a*, 40*b*, the remaining channels are continuously being processed through the audio processing loop 30. The data in each retiming RAM 40*a*, 40*b* are encoded such that the data remains in each retiming RAM 40*a*, 40*b* only for the amount of time necessary to process the lower 3 bits of the audio data sample. Each retiming RAM 40*a*, 40*b* acts as a fine adjustment to the coarse period resolution provided by the audio loop 30. Once the data have left each retiming RAM 40*a*, 40*b* the data enters one of two holding RAMs 42*a*, 42*b*. In the preferred embodiment, two holding RAMs 42*a*, 42*b*** are provided to speed up the processing of the audio data samples. It is to be understood that any number of holding RAMs may be used without departing from the scope and spirit of the present invention.

In the preferred embodiment, each holding RAM **42*a*, 42*b* is 18 bits wide and 4 bits deep. The data for a particular data sample remains in either holding RAM 42*a*, 42*b* until the next data sample for that particular audio channel is processed. Each holding RAM 42*a*, 42*b* also determines the ultimate destination of the audio data from each audio channel. The data from each holding RAM 42***a*, 42*b* is directed to a particular audio channel output by a plurality of AND gates 43*a*, 43*b*, 43*c* and 43*d*. Data contained within each audio channel can be transmitted to a left audio channel 52, a right audio channel 54, both audio channels or neither audio channel. A mono bit can also be included in the audio data sample which causes all 8 audio channels to be sent to both the left audio channel 52 and the right audio channel 54. This results in a monophonic sound being produced. Alternatively, all 8 audio channels can be sent just to the left audio channel 52 or just to the right audio channel 54.

Once the data have been directed to a particular audio channel, the data samples for all audio channels being held by each holding RAM 42*a*, 42*b* are added together in one of two adders 44*a*, 44*b*. In the preferred embodiment each adder 44*a*, 44*b* is directed to a particular audio channel. The first adder 44*a* is directed to the left audio channel 52 and the second adder 44*b* is directed to the right audio channel 54. The added data can expand up to 20 bits of data.

The data samples next enter one of two scaling circuits 46*a*, 46*b*. Each scaling circuit 46*a*, 46*b* is programmable to select one of three ranges of 16 output bits from the 20 bits transmitted to exit from the circuit since it is preferable that the audio system only handle 16 bits of audio data at one time. The three ranges are defined as from bit 19 to bit 4 (19:4), bit 18 to bit 3 (18:3) or bit 17 to bit 2 (17:2). In the preferred embodiment, if the data exceeds 16 bits the least significant bits are removed from the data. This scaling is provided to allow less than eight channels per DAC to approach full scale output, and to prevent clipping when multiple channels are added. The scaled data next enters a pair of digital to analog converters 50*a*, 50*b*. The digital to analog converters 50*a*, 50*b* convert the digital audio data to an analog signal. In the preferred embodiment, a first digital to analog converter 50*a* is directed to a left audio channel 52 and a second digital to audio converter 50*b* is directed to a right audio channel 54. The analog audio data are transmitted to an amplifier where the audio signals are amplified and then transmitted to a loudspeaker for audio output. The analog signals produced by the audio circuit have a sampling frequency of at least 44 KHz to produce CD quality sound. However, it is to be understood by those skilled in the art that audio outputs of higher sampling frequencies may be maintained without departing from the scope and spirit of the present invention. In the preferred embodiment, the sampling frequency falls within a range of 55 Hz to 110 KHz.

Alternatively, instead of transmitting the data through the scaling circuits 46*a*, 46*b* to the pair of digital to analog converters 50*a*, 50*b*, the audio data samples 12 may be transmitted by a digital output shift register 56 to an external device (not shown). The digital output shift register 56 is capable of receiving and outputting the entire 20 bit data sample. The digital output shift register 56 is typically activated when a user of the system wishes to capture more of the audio sound than is capable of being produced by the audio digital to analog converters 50*a*, 50*b*. The digital output shift register 56 is switched on when an external device is electronically connected to the audio circuit. A type of external device which may be connected by a cable to the digital output shift register 56 includes, but is not limited to, an external digital to analog converter, a direct digital input, an audio digital tape device or any other type of suitable audio equipment.

Each bit of the 20 bit data sample is transmitted through the digital output shift register 56 on a clock pulse leading edge for 20 consecutive clock pulses. In the preferred embodiment, the clock pulses for the digital output shift register 56 is 70 ns. This allows the audio data to be quickly processed and received by the external device.

Figure 3:
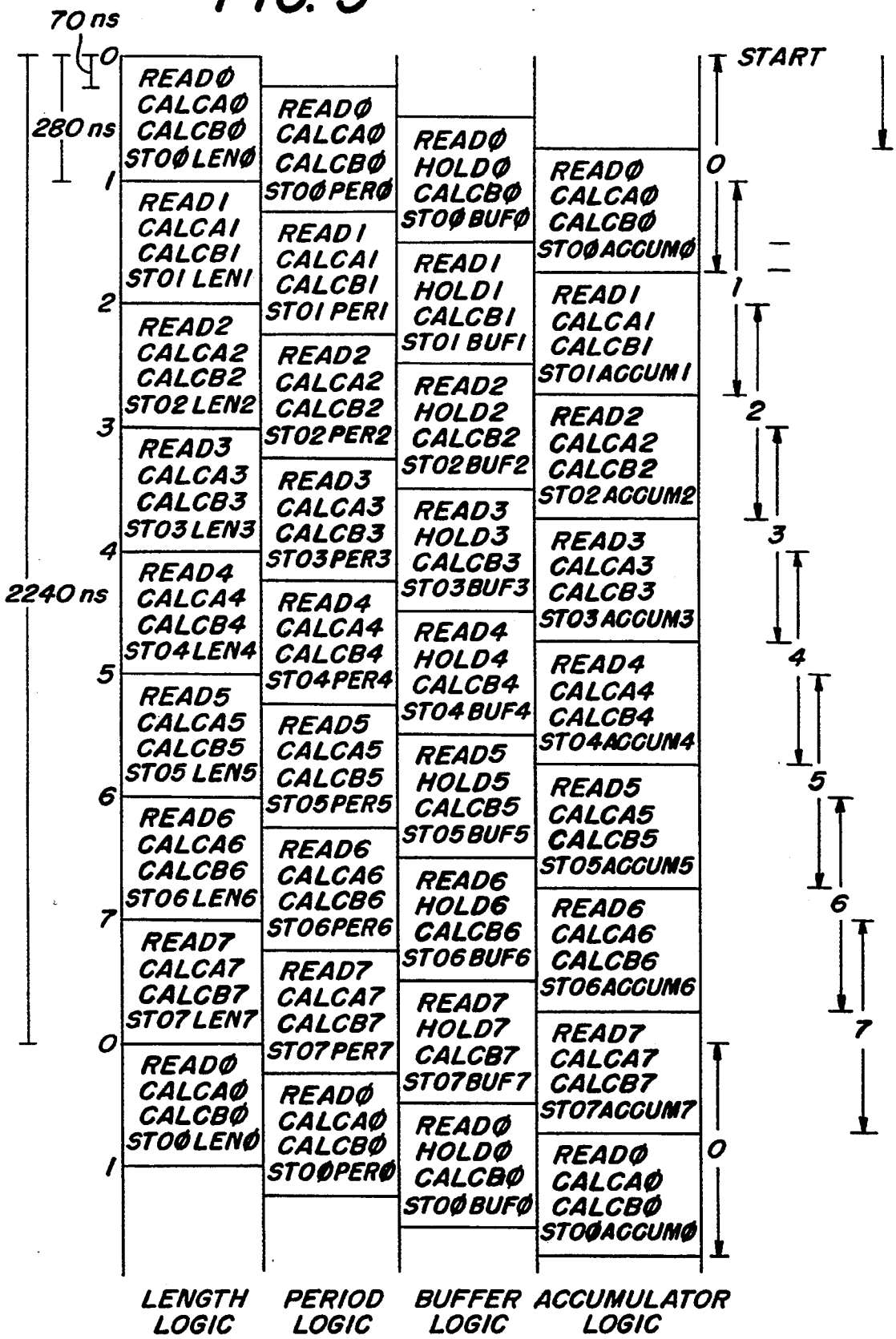
FIG. 3 is a chart of the flow of audio data through the audio channel system of FIG. 2.

Referring specifically to FIG. 3, there is shown a schematic chart of the overall processing scheme for each piece of data associated with each audio channel as it is processed by the audio processing loop 30. Each block on the graph represents a single clock pulse and contains the operations performed during each clock pulse. As discussed above, each clock pulse is typically 280 ns and comprises four clock ticks with each being 70 ns in duration.

Each audio channel comprises four pieces of data which must be processed; the length data, period data, buffer data and the accumulator data. A portion of each piece of data is processed each time it travels through the audio processing loop 30. Each piece of data for each audio channel is pipelined into the audio processing loop 30 on a clock tick and is staggered such that there is a one clock tick delay between each succeeding piece of data. In this manner, at every fourth tick all four pieces of data for a single audio channel are processed simultaneously. This staggered arrangement of processing each piece of data for each audio channel allows all eight audio channels to be processed within eight clock pulses. In addition, when the processing of each piece of data for a given audio channel is completed, the piece of data for the next audio channel is immediately processed.

By processing each audio channel in the described manner, the data can be efficiently processed at a speed capable of producing high quality sound. In addition, each audio channel is constantly pipelined through the audio processing loop 30 such that the audio processing loop is continually processing the audio data samples.

As discussed above, each piece of data requires four processing steps of which each processing step requires at least one clock tick. The first piece of data to be processed by a given audio channel is the length data. In the preferred embodiment, the length data comprises 26 bits, 18 bits which are contained in the variable RAM 32 and 8 bits which are contained in the control RAM 34. Of the 18 bits contained within the variable RAM 32, 16 of the bits contain data and the remaining two most significant bits contain zeros.

The first processing step for the length data requires that the length data be read from the variable RAM 32. Once the length data is read from the variable RAM 32, a calculation A ("calcA") step is performed which determines if the period has timed out, i.e., if a period counter associated with the period data equals zero. The period also signifies that a particular sound waveform has finished being processed. At the conclusion of each period, i.e., when the period has timed out, new length data must be retrieved from the parameter RAM 22. If the period is not timed out, a calculation B ("calcB") operation is performed which determines whether a length counter associated with the length data equals zero. The length counter represents the number of data samples in the sound waveform which have not been processed. If the length counter equals zero, additional length data must be retrieved from the parameter RAM 22. If the length counter does not equal zero, the length counter is decremented by one. The resulting length data or the length data retrieved from the parameter RAM 22 are cycled through the audio processing loop 30 and stored within the variable RAM 32 until the next time the particular audio channel cycles through the audio processing loop 30 which is usually 8 clock pulses.

The period data are preferably 26 bits in length and comprises 18 bits which are contained within the variable RAM 32 and 8 bits which are contained within the control RAM 34. Of the 18 bits contained within the variable RAM 32, 16 bits contain period data and the two most significant bits contain zeros. The first processing step for the period data requires that the period data be read from the variable RAM 32. Next it is determined in step calcA whether the period has timed out, i.e., whether the period counter equals zero. If the period has timed out, additional period data must be retrieved from the parameter RAM 22. If the period has not timed out, a calcB step is performed which decrements the period data by one. The decremented period data or the retrieved period data from the parameter RAM are cycled through the audio processing loop 30 and stored within the variable RAM 32 until the particular audio channel cycles through the audio processing again.

The buffer data are 26 bits in length and comprises 18 bits which are stored within the variable RAM 32 and 8 bits which are stored within the control RAM 34. As discussed above, the buffer data contains the audio data samples to be processed. In the preferred embodiment, of the 18 bits contained within the variable RAM 32, 16 bits contain data and the two most significant bits contain zeros. Additionally, the 8 bits of the control RAM 34 are preferably the 8 most significant bits of the volume bits. In the first step of the buffer data, the 8 most significant bits of volume are read from the control RAM 34. Once the volume bits have been read from the control RAM 34, a hold operation occurs until the next clock tick occurs. After the hold operation, a calcA operation occurs in conjunction with a calcB operation performed on the accumulator data as will be described in more detail hereinafter. The remainder of the buffer data cycles through the loop and are stored within the variable RAM 32 in the fourth clock tick.

The accumulator data is 26 bits in length and comprises 18 bits of data within the variable RAM 32 and 8 bits within the control RAM 34. All 18 bits contained within the variable RAM 32 contain accumulator data. Additionally, the 8 bits contained within the control RAM 34 contain the four least significant bits of volume as well as three bits relating to the multiply state which will be described in more detail hereinafter.

Referring specifically to FIG. 4, there is shown a detailed logic diagram depicting the processing of each piece of data contained within each audio channel within the audio processing loop 30.

Figure 4A:
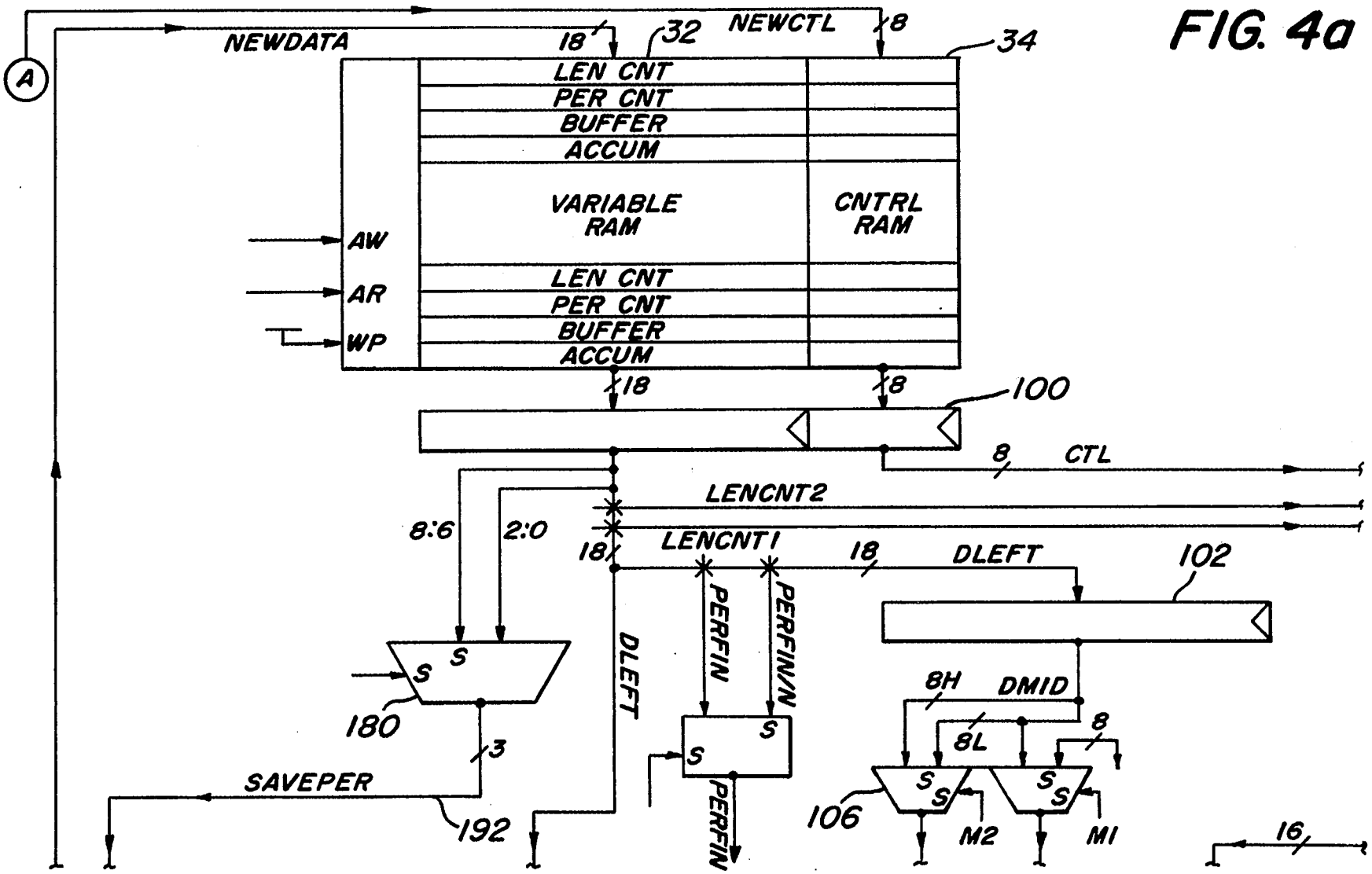
FIGS. 4*a*–4*d* are a detailed logic diagram of the audio processing loop of the audio channel system of FIG. 2.
Figure 4B:
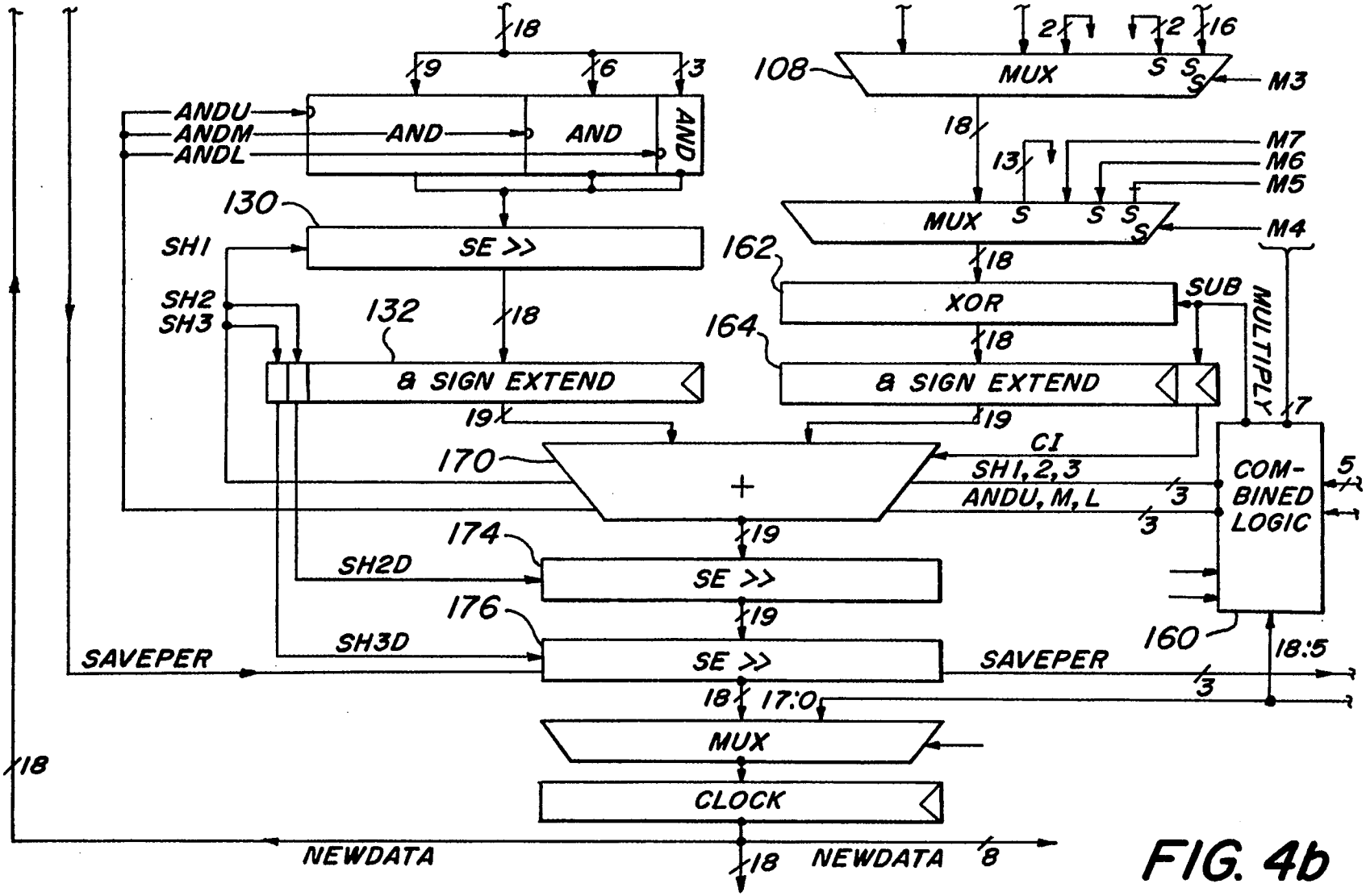
Figure 4C:
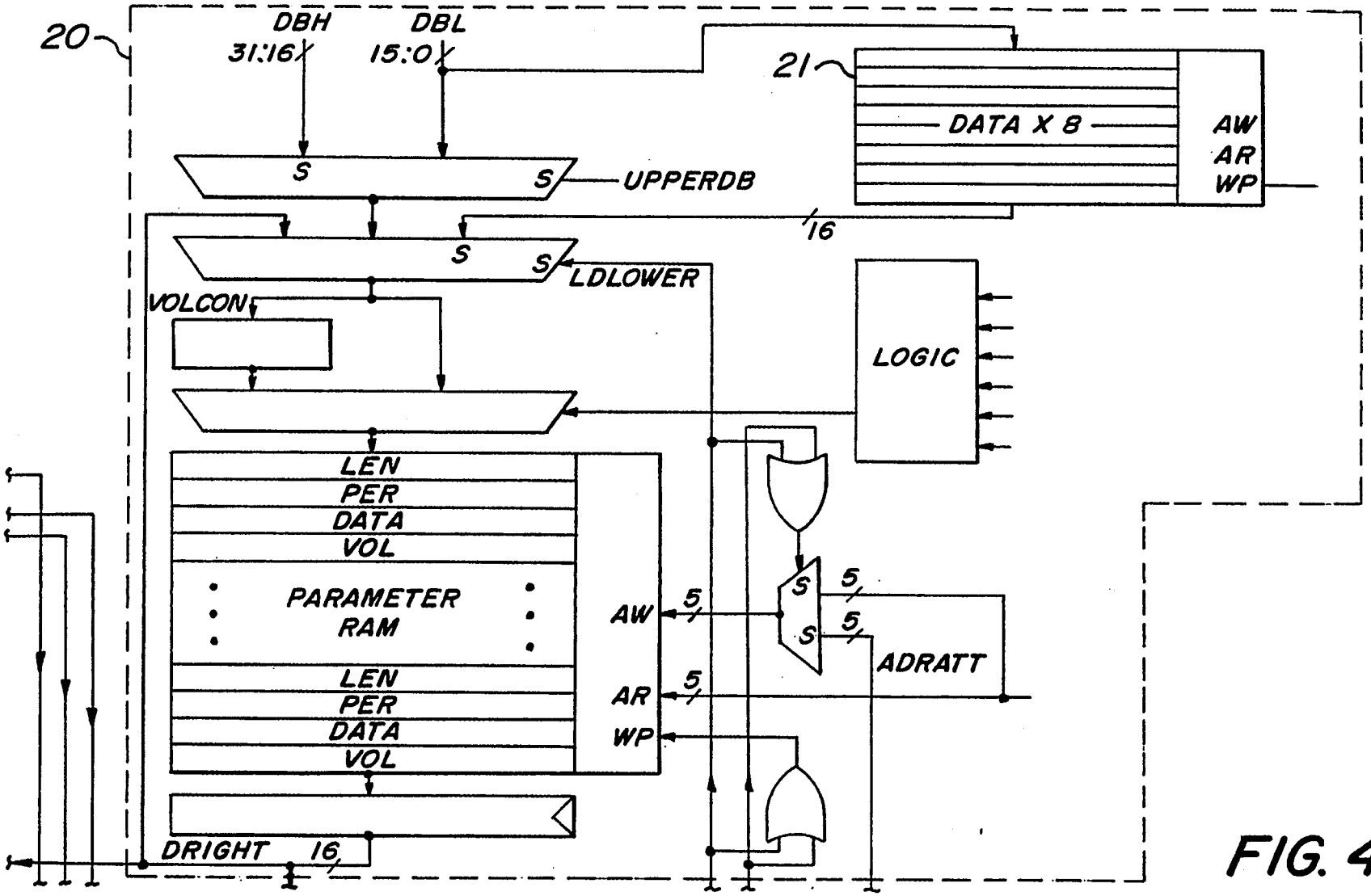
Figure 4D:
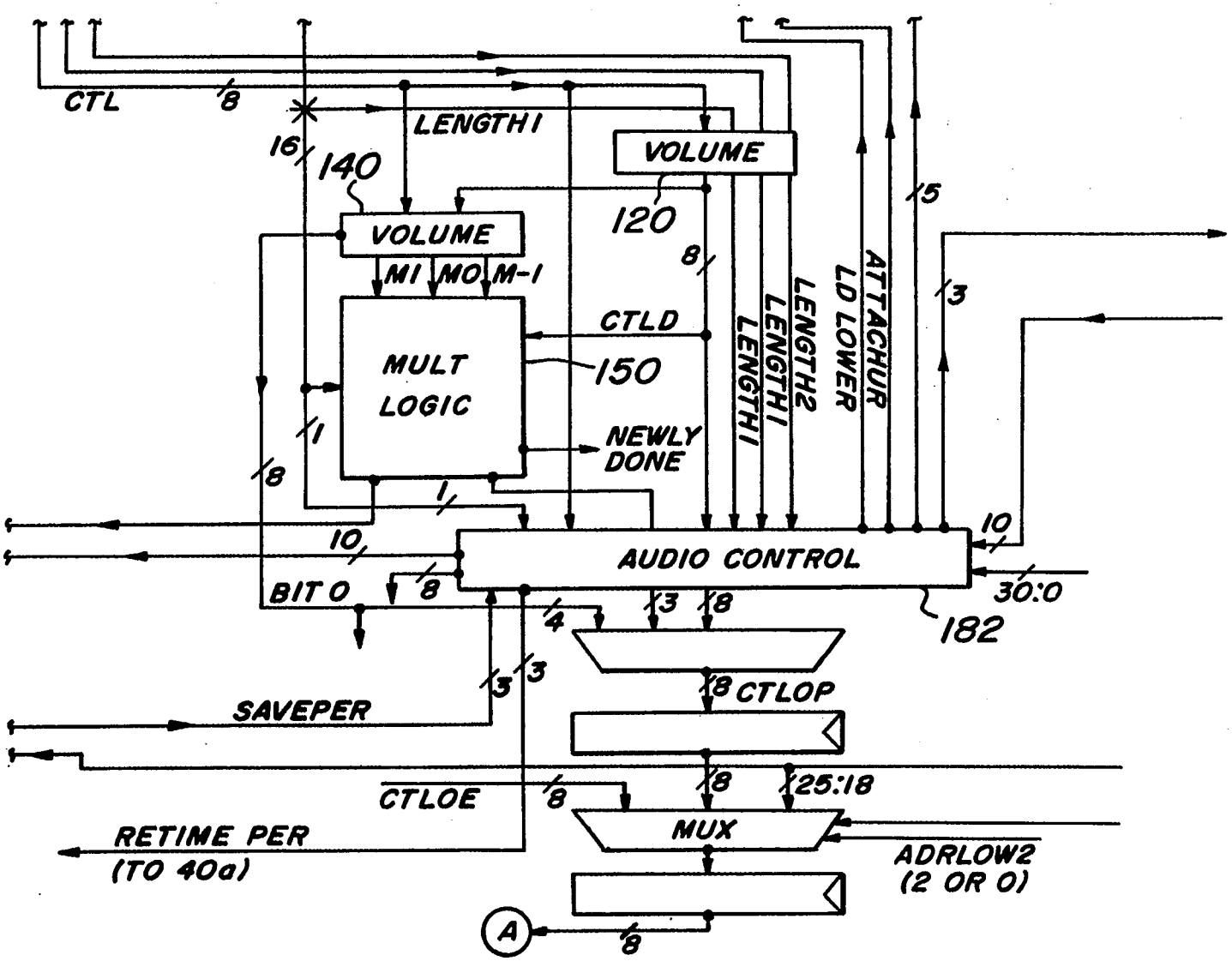

The buffer data are read from the variable RAM 32, and the control RAM 34 and is transmitted to a flip flop register 100 (FIG. 4*a*) which holds the data until the rising edge of the next clock pulse. The flip flop register 100 directs the 18 bits of buffer data from the variable RAM 32 to a second flip flop register 102. The flip flop register 102 determines whether the data contained within the buffer is a single 16 bit word or two 8 bit words. If the sample comprises two 8 bit words, the 8 bit word contained within the upper 8 bits of the 16 bit buffer are processed first and transmitted to a multiplexer 108 (FIG. 4*b*). Once the upper 8 bits have been processed, the lower 8 bits will be transmitted to the multiplexer 108. If the buffer data contains a 16 bit word, the entire 16 bit word is transmitted to the multiplexer 108.

At the same time, the 8 control bits, which are the 8 most significant volume bits, initially stored within the flip flop register 100 are transmitted to a volume hold circuit 120. The volume hold circuit 120 retains the 8 most significant volume bits from the buffer data until the accumulator data is received which contains the 4 least significant bits of volume. At this point, this is the completion of the calcA function for the buffer data.

At the same time the calcA function for the buffer data is being performed, the accumulator data is being read from the variable RAM 32. The accumulator data passes through the circuit until it reaches a shift register 130. At this point, the control RAM 34 also reads the control data for the accumulator. Contained within the control data for the accumulator are the 4 least significant volume bits and the multiply state. In the preferred embodiment, the multiply state is a three bit code which is used to determine what operations are to be performed by the accumulator data and buffer data based on a modified version of Booth's algorithm. The 4 least significant volume bits are transmitted through the circuit and contained within the volume hold circuit 120 (FIG. 4*d*) with the 8 most significant volume bits from the buffer. At the same time, the multiply state bits are received by a volume circuit 140. The volume circuit 140 decodes the multiply state bits which form a 3 bit code M1, M0, M-1. The 3 bit code M1, M0, M-1 is transmitted to a multiply logic circuit 150 which contains a table corresponding to a series of operations which are performed in accordance with the Modified Booth's algorithm which is well known to those skilled in the art. The Modified Booth's algorithm is a method used to perform the multiplication of two binary numbers. The conventional simple Booth's algorithm is designed to multiply one bit at a time.

Figure 7A:
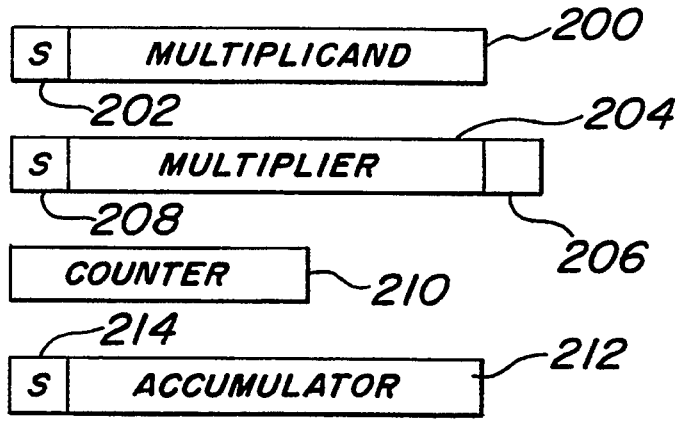
FIGS. 7*a* and 7*b* are a general flow diagram depicting the Modified Booth Multiply algorithm.
Figure 7B:
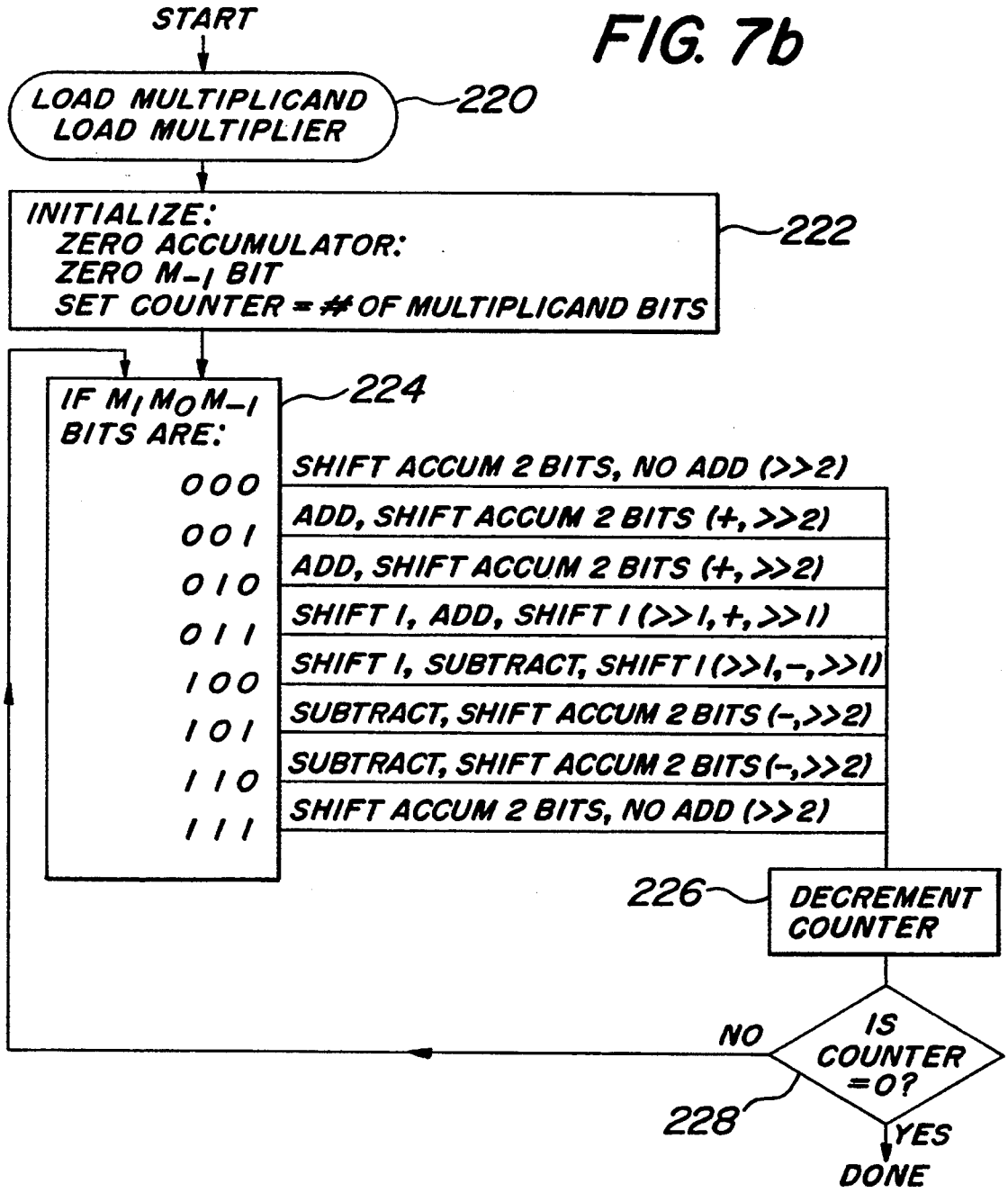

Referring to FIGS. 7*a* and 7*b*, there is shown a flow chart depicting the Modified Booth's Multiply algorithm. FIG. 7*a* illustrates the registers used in calculating the Modified Booth's algorithm. A first register is a multiplicand register 200. The first bit of the multiplicand register 200 is a sign bit 202 which indicates if the register is positive or negative. The multiplicand register 200 is preferably 16 bits in length and contains data from the buffer.

A second register is a multiplier register 204. The multiplier register 204 includes an extra bit 206 which is required for properly performing the Modified Booth's algorithm. The multiplier register 204 is preferably 13 bits in length and contains volume data. The multiplier register 204 also includes a sign bit 208 for indicating if the register is positive or negative.

A third register is a counter 210 which keeps track of the calculation stage of the Modified Booth's algorithm. The counter 210 is preferably a 4 bit counter.

A fourth register is the accumulator register 212 which contains the partial products of the multiplicand and multiplier after each multiplication is performed and ultimately stores the end result or end product. The accumulator register 212 also includes a sign bit 214 which is preserved as each multiplication step is performed.

Referring to FIG. 7*b*, there is shown a flow diagram depicting the Modified Booth's algorithm. In block 220, a multiplicand is loaded into the multiplicand register 200 and a multiplier is loaded into the multiplier register 204. Next, an initialization process occurs in block 222. The initialization process includes setting the accumulator register 212 to zero, setting the extra bit 206 in the multiplier register 204 otherwise referred to as M-1 to zero and setting the counter 210 equal to the number of multiplicand bits which is preferably 12. Next, the identity of the multiplicand bits is determined in block 224. The value of the multiplicand bits determines the next operation to be performed. Once a given operation has been performed, the counter 210 is decremented by 1 at block 226. Next, the value of the counter is determined at block 228. If the counter equals zero then the multiplication process is complete. If the counter does not equal zero, the next multiplication is performed.

The present invention uses the Modified Booth's multiply algorithm which shifts 2 bits at a time as shown in FIG. 7*b*. In this way, the multiply operation, which uses a 12 bit multiplier, can be completed in 6 operations, i.e., 6 cycles through the audio processing loop 30, as opposed to 12 operations if a simple Booth's multiply was used. In the first cycle through the audio processing loop 30, an extra bit, number M-1, is set to zero and the 2 least significant volume bits are accordingly placed in bits M1 and M0. These bits are transmitted to a multiply logic circuit 150 (FIG. 4*d*) which compares the bit numbers to the table stored within the multiply logic which provides the instruction command for performing the next step in the Modified Booth's algorithm.

Figure 5:
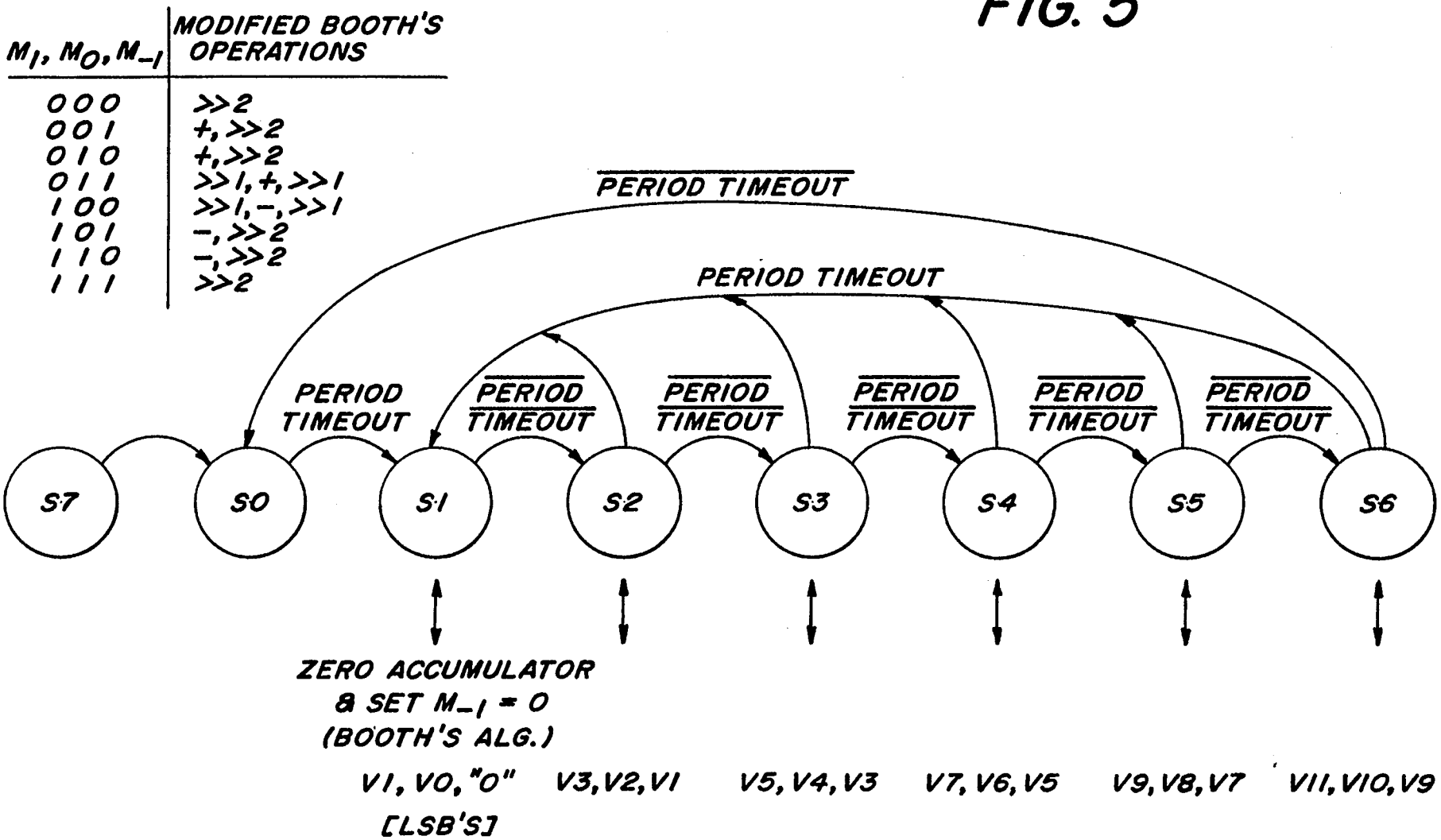
FIG. 5 is a chart and diagram which defines the multiply states of the audio data transmitted through the audio processing loop of the audio channel system of FIG. 2.

Referring to FIG. 5, there is shown a chart and graph illustrating the types of instruction commands which are to be performed by the audio circuit in view of the Modified Booth's algorithm. Referring to the chart, it can be seen that each 3 bit code M1, M0, M-1 represents an operation or operations to be performed on the accumulator data and buffer data. The operations which can be performed include shifting the accumulator data by at least one bit, adding or subtracting the accumulator data and buffer data or shifting the resulting sum of the accumulator data and buffer data by one or two bits. It is to be understood by those skilled in the art that the symbol "> >" signifies a shift operation. It is also noted that for each multiply state, the last bit of the previous multiply state is the same as the first bit of the next multiply state. Three of the volume bits are labeled as M1, M0, M-1 for each operation. After each operation is performed on the first three bit code, for example, V1, V0, 0, the next three bit code is formed by shifting the data by two bits for each partial sum. Therefore, the next three bit code would be V3, V2, V1. This process continues until a partial sum has been taken for all of the volume bits.

For example using a modified Booth's bit code, if the 3 bit code is 000, a shift right twice instruction is transmitted to a combined logic circuit 160 (FIG. 4*b*). The combined logic circuit 160 thereby provides the instructions necessary to perform the desired operation. The buffer data is transmitted through an XOR circuit 162 and a sign extend circuit 164 which maintains the sign of the data, i.e., whether it is negative or positive. At the same time, the accumulator data is transmitted through a shift register 130 and a sign extend circuit 132 which maintains the integrity of the sign for the accumulator data into an adder circuit 170. The combined accumulator data and buffer data, which is now stored within the accumulator data, is then transmitted through a pair of shift registers 174, 176 which perform the required shift right twice instruction. The resultant accumulator data is transmitted through the remainder of the audio loop 30 and stored within the variable RAM 32.

A turbo mode may also be included in which a trade off occurs between the processing speed and the number of multiplier bits which can be processed. For example, only 8 volume bits may be processed by the audio processing loop 30 instead of 12 bits. By processing fewer volume bits, a 50% increase in processing speed can be achieved without adversely affecting sound quality. The faster processing speed allows for higher audio sampling rates.

Turbo mode forces the multiply state machine to multiply the buffer data by only the 8 most significant bits of the volume, using only 4 processing loops.

Figure 6A:
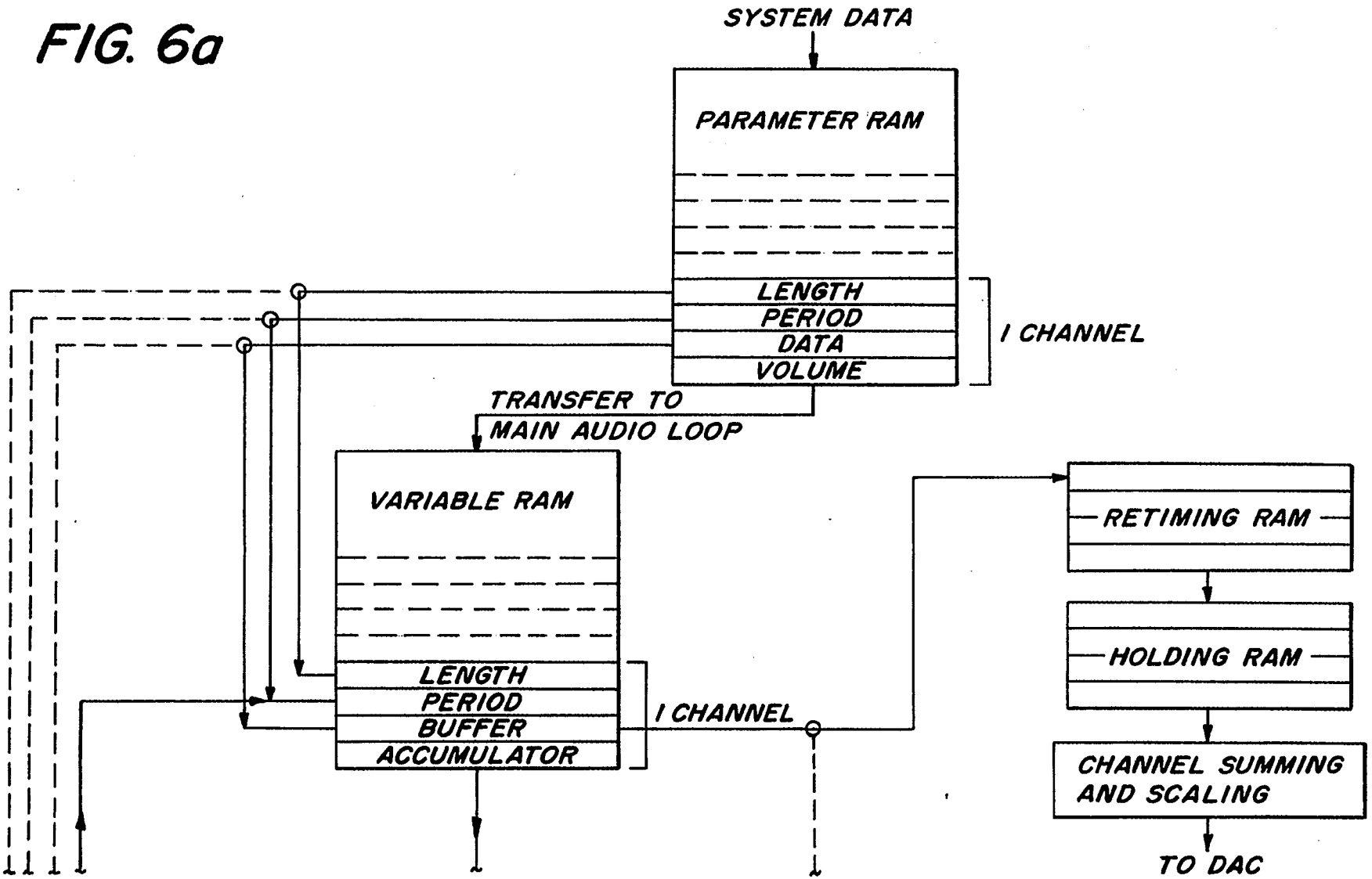
FIGS. 6*a* and 6*b* are a general flow diagram depicting the processing of the length data and period data transmitted through the audio processing loop of the audio channel system of FIG. 2.
Figure 6B:
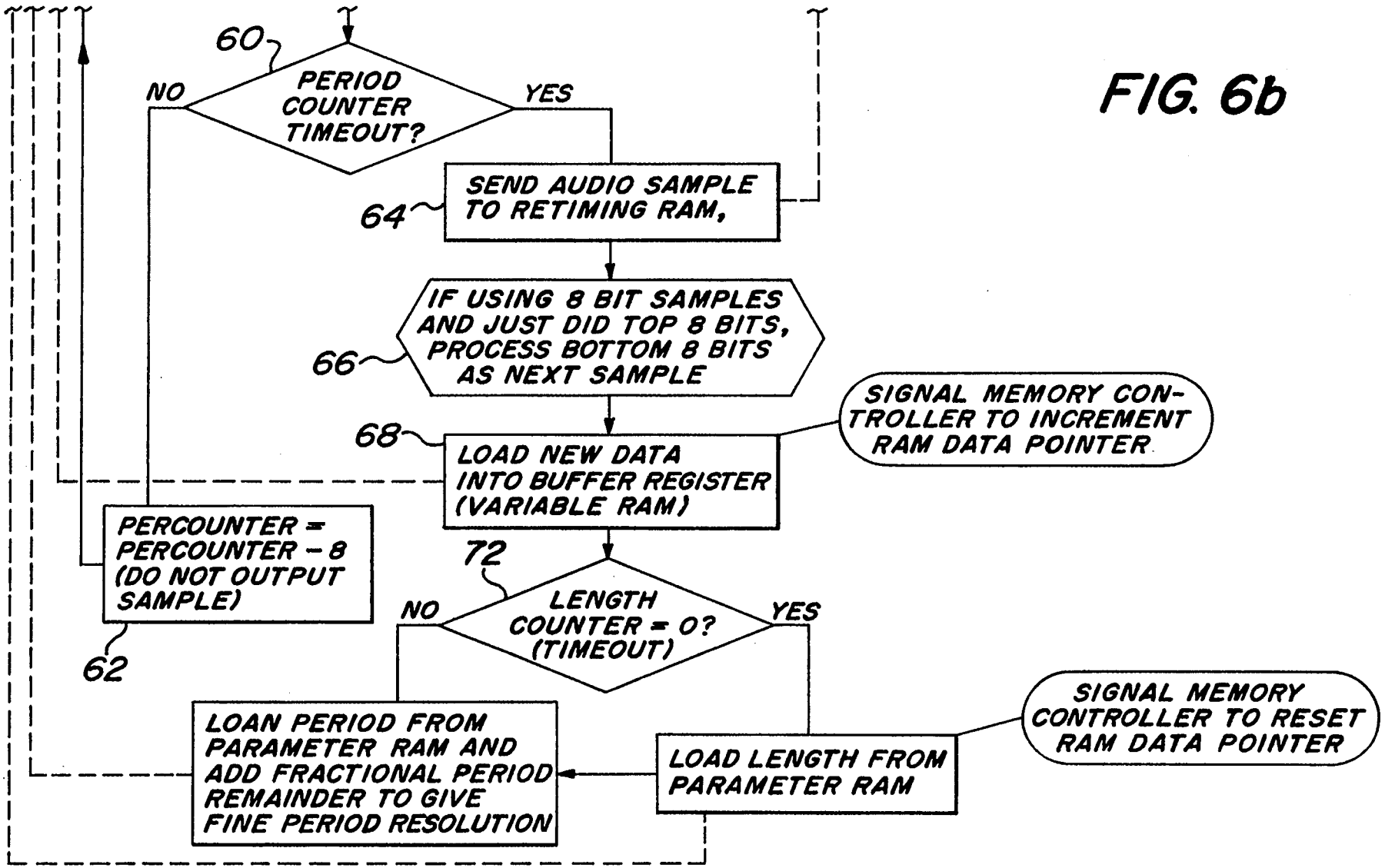

Referring to FIG. 6, there is shown a flow diagram depicting the processing of the length data and period data located within a single audio channel through the audio processing loop 30. It is to be understood by those skilled in the art that the processing description is limited to one audio channel for purposes of simplicity, and that each audio channel is processed in substantially the same manner.

The period data represent the amount of time each audio data sample 12 is played and is represented by a fixed number of clock pulses. The period count determines when the period has timed out. Once the period data bits enter the processing loop 30, it is determined at block 60 whether the period counter has timed out. A period timeout indicates the end of a particular data sample 12. If the period is not timed out, the counter is reduced by 8 at block 62. The number 8 indicates the number of clock pulses by which the period is reduced. Since it takes one clock pulse to travel through the processing loop 30, and since each of the 8 audio channels is pipelined through the audio processing loop 30 prior to reentering the loop, it will take 8 clock pulses before the audio channel reenters the loop.

If the period counter has timed out, this indicates that the audio data sample 12 has been completely processed. The audio sample is then sent to the retiming RAM 40 at block 64 for fine adjustment processing. Next, it is determined in block 66 whether the audio sample is a 16 bit word or two 8 bit words. If the audio sample is two 8 bit words and only one 8 bit word has been processed, then the lower 8 bit word is processed by the audio processing loop 30. Next, the variable RAM 32 must be informed that additional data needs to be transferred into the buffer register. These additional data represent the next audio data sample 12 within the sound waveform.

Once the period data bits have been processed, the data bits enter the length data bits processing portion of the loop. The length indicates the number of 16 bit words, which store either one 16 bit data sample or two 8 bit data samples 12, which are contained within a sound waveform and is represented by a length count value. Each time a 16 bit word is processed, the length count value is decremented by one. At block 72, it is determined whether the length counter equals zero, which signifies a timeout. If the length counter is not equal to zero, then more data still remains to be processed and the length bit is unchanged. However, since it has been indicated that the period counter is timed out, period data must be loaded from the parameter RAM 22 and provided with a fractional remainder which provides fine period resolution. Since 8 clock pulses are required for each audio channel to travel once through the audio processing loop, if the period value is not a multiple of 8, the remainder data bits will be processed in the retiming RAM 40 to provide fine resolution to the audio sample.

If the length counter equals zero, then the length data bits have timed out and new length data bits must be loaded from the parameter RAM 22. When the length data bits time out, this signifies that the sound waveform has been completely processed. As such, a new sound waveform must be received from the data input circuit 20. Again, since the period has been indicated as being timed out, period data must be loaded from the parameter RAM 22 and provided with additional data bits for providing fine resolution of the data sample.

Referring back to FIG. 4, the audio processing loop may also include a period fine mode for providing a higher perceived degree of resolution. The period fine mode is a technique for causing the audio processing loop 30 to extend the period for that one of N samples such that its period is 280 n longer than the other samples for that channel. In the preferred embodiment, N is a number which can be programmed into the audio processing loop 30 and is between 1 and 64. The period fine mode affects the 6 least significant bits of the period data. A value from 1–64 is chosen such that when the period reaches a predetermined point a particular sample is delayed by 280 ns. By increasing the period by this fractional period of time for the one delayed sample, the resulting resolution is improved and the period of the waveform which is to be produced can be more precisely specified.

During the period fine mode, the 16 bit period register is divided into two parts. The first part is a 10 bit integer period binary number and the second part is a 6 bit binary number which represents the fractional period. The fractional binary number can hold one of 64 values which are used to adjust the integer period by an additional x/64 parts which x is the fractional number value.

Each time the integer period binary number is decremented, the fractional period is incremented by the fractional portion of the period value. The accumulation of these fractional additions will eventually cause the fractional period binary number to be incremented during a fractional addition and as a result cause a delay in the timeout of the period counter by one 280 ns tick so that the sample output time is delayed by 280 ns for that period timeout. The end result is that the period increases in length by the fractional period binary number when averaged over a number of period time outs.

The period fine mode is initiated by a period fine signal (audperf) 190 which is received by a multiplexer 180. The multiplexer 180 transmits a 3 bit save period signal (saveper) 192 which is received by an audio control circuit 182 which synchronizes the period data. These 3 bits are the retiming bits which are taken from bits 8, 7, 6 for period fine mode. A derived logic signal retimeper then enters the retiming RAM 40 and increases the period the designated value.

From the foregoing description, it can be seen that the present invention comprises an audio channel system for outputting an analog signal corresponding to a sound waveform in a personal computer system. It will be appreciated by those skilled in the art that changes could be made to the embodiment described above without departing from the broad inventive concepts thereof. It is understood, therefore, that this invention is not limited to the particular embodiment disclosed, but is intended to cover all modifications which are within the scope and spirit of the present invention as defined by the appended claims.

We claim:

1. An audio channel system for providing an analog signal corresponding to a sound waveform in a computer system, the computer system including a processor, a system memory for storing data, and a data bus coupled to the audio channel system for transmitting audio input, the audio channel system comprising:

a plurality of audio channels, each audio channel containing a predetermined number of audio data samples for producing a particular sound waveform;

a plurality of volume bits defining a volume level at which each audio data sample is played;

audio processing means for processing the sound waveforms for each audio channel, said audio processing means acting as a shared processing element which receives said audio data samples from each said audio channel, said audio processing means dividing each of the audio data samples into a plurality of data such that said plurality of data for each audio data sample is pipelined through said audio processing means in a serial manner to produce processed data samples, the plurality of data for each audio data sample for each audio channel being in various processing stages at any given time, said audio processing means combining said processed data samples and said volume bits to produce an audio output signal for each audio channel; and output means for combining the audio output signals of each audio channel to produce a total audio output signal;

said audio processing means further comprising:

clock means for determining the length of time necessary for processing each data sample of each audio channel by said processing means;

fine adjustment means for fine tuning each data sample;

holding means for holding a processed data sample from a particular audio channel until the next data sample from that particular audio channel is processed;

data sample directing means for directing said processed data sample to either a left audio channel or a right audio channel or both;

scaling means for scaling said processed data sample such that said data sample does not exceed a predetermined number of bits;

a first digital to analog converter for receiving data samples which have been directed to said left audio channel and converting said data samples into analog sound signals; and a second digital to analog converter for receiving data samples which have been directed to said right audio channel and converting said data samples into analog sound signals.

2. An audio channel system according to claim 1, wherein said clock means is a 280 ns clock.

3. An audio channel system according to claim 1, wherein said fine adjustment means is a retiming RAM.

4. An audio channel system according to claim 3, wherein said retiming RAM is capable of processing from 0 to 7 retiming delays.

5. An audio channel system for providing an analog signal corresponding to a sound waveform in a computer system, the computer system including a processor, a system memory for storing data, and a data bus coupled to the audio channel system for transmitting audio input, the audio channel system comprising:

a plurality of audio channels, each audio channel containing a predetermined number of audio data samples for producing a particular sound waveform;

a plurality of volume bits defining a volume level at which each audio data sample is played;

audio processing means for processing the sound waveforms for each audio channel, said audio processing means acting as a shared processing element which receives said audio data samples from each said audio channel, said audio processing means dividing each of the audio data samples into a plurality of data such that said plurality of data for each audio data sample is pipelined through said audio processing means in a serial manner to produce processed data samples, the plurality of data for each audio data sample for each audio channel being in various processing stages at any given time, said audio processing means combining said processed data samples and said volume bits to produce an audio output signal for each audio channel; and output means for combining the audio output signals of each audio channel to produce a total audio output signal;

said plurality of volume bits equaling twelve, said volume bits being multiplied with said processed data samples in sets of two volume bits in accordance with a Modified Booth's algorithm.

6. An audio channel system for providing an analog signal corresponding to a sound waveform in a computer system, the computer system including a processor, a system memory for storing data, and a data bus coupled to the audio channel system for transmitting audio input the audio channel system comprising:

a plurality of audio channels, each audio channel containing a predetermined number of audio data samples for producing a particular sound waveform;

a plurality of volume bits defining a volume level at which each audio data sample is played;

audio processing means for processing the sound waveforms for each audio channel, said audio processing means acting as a shared processing element which receives said audio data samples from each said audio channel, said audio processing means dividing each of the audio data samples into a plurality of data such that said plurality of data for each audio data sample is pipelined through said audio processing means in a serial manner to produce processed data samples, the plurality of data for each audio data sample for each audio channel being in various processing stages at any given time, said audio processing means combining said processed data samples and said volume bits to produce an audio output signal for each audio channel; and output means for combining the audio output signals of each audio channel to produce a total audio output signal;

said audio processing means further including an audio processing loop which processes in each loop a portion of said plurality of data and a set of volume bit pairs, said audio processing loop processing the plurality of data until each audio data sample produced by each audio channel has been completely processed.

7. An audio channel system according to claim 6, wherein said plurality of data comprises length data, period data, volume data and audio data.

8. An audio channel system according to claim 6, wherein each audio data sample includes period data representing an amount of time each audio data sample is played, the system further comprising period fine means for increasing the period data by a fractional amount for each audio data sample.

9. In an audio channel system comprising a plurality of audio channels each containing a predetermined number of audio data samples, an audio processing loop which acts as a shared processing element for processing the audio data samples of each audio channel and output means for outputting the processed audio data samples, a method for outputting an analog signal corresponding to a digital sound waveform comprising the steps of:

a. transmitting audio data samples to the plurality of audio channels from a data input circuit;

b. separating each transmitted audio data sample into length data, period data, buffer data and accumulator data;

c. transmitting one of said audio data samples for each channel to the audio processing loop;

d. pipelining said length data, period data, buffer data and accumulator data in a staggered manner for a first audio channel through said audio processing loop;

e. multiplying said buffer data and accumulator data of said first audio channel in accordance with Modified Booth's algorithm;

f. storing the product of the buffer data and the accumulator data in memory;

g. pipelining said length data, period data, buffer data and accumulator data in a staggered manner for a succeeding audio channel through said audio processing loop once the audio data sample for a preceding audio channel has been stored;

h. multiplying said buffer data and accumulator data of said succeeding audio channel in accordance with the Modified Booth's algorithm;

i. storing the product of the buffer data and the accumulator data for the succeeding audio channel in memory;

j. repeating steps g–i until all of the audio channels have entered the audio processing loop;

k. repeating steps c–j until each audio data sample for each audio channel has been completely processed; and l. combining the processed audio data samples from each audio channel to produce an audio output through the output means, the audio output having a sampling frequency of up to 110 KHz.

10. A method according to claim 9, further comprising the steps of:

processing the pipelined length data and period data for each audio channel to determine if a timeout condition has occurred;

requesting additional audio samples from the data input circuit if a timeout condition occurs;

processing the length data and the period data if the timeout condition has not occurred; and storing the new length data and buffer data in a variable RAM.

* * * * *